US008894357B2

(12) United States Patent
Liu et al.

(10) Patent No.: US 8,894,357 B2
(45) Date of Patent: Nov. 25, 2014

(54) FAN MODULE

(75) Inventors: Yang Liu, Shenzhen (CN); Lei Liu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 367 days.

(21) Appl. No.: 13/303,158

(22) Filed: Nov. 23, 2011

(65) Prior Publication Data

US 2013/0101411 A1 Apr. 25, 2013

(30) Foreign Application Priority Data

Oct. 19, 2011 (CN) ..... 2011 1 0318168

(51) Int. Cl.
*F04D 29/40* (2006.01)
*F04D 25/16* (2006.01)
*F04D 29/64* (2006.01)

(52) U.S. Cl.
CPC ..... *F04D 25/166* (2013.01); *F04D 29/646* (2013.01)
USPC ..... 415/126; 415/190; 415/213.1; 416/11; 416/246

(58) Field of Classification Search
USPC ..... 415/182.1, 190, 213.1, 232, 126, 148, 415/150; 416/11, 244 R, 246
See application file for complete search history.

(56) References Cited

U.S. PATENT DOCUMENTS

| | | | | |
|---|---|---|---|---|
| 4,751,872 | A * | 6/1988 | Lawson, Jr. | 454/184 |
| 6,288,897 | B1 * | 9/2001 | Fritschle et al. | 361/679.48 |
| 7,002,796 | B2 * | 2/2006 | Lao et al. | 361/695 |
| 7,355,115 | B2 * | 4/2008 | Liang | 174/50 |
| 7,379,300 | B1 * | 5/2008 | Chen | 361/695 |
| 7,439,453 | B2 * | 10/2008 | Murano et al. | 174/543 |
| 7,748,955 | B2 * | 7/2010 | Lee | 415/119 |
| 8,405,983 | B2 * | 3/2013 | Chen | 361/690 |
| 8,441,781 | B2 * | 5/2013 | Chiang | 361/679.01 |
| 8,477,496 | B2 * | 7/2013 | Zhang et al. | 361/695 |
| 8,570,743 | B2 * | 10/2013 | Pang et al. | 361/695 |
| 2006/0203446 | A1 * | 9/2006 | Radhakrishnan et al. | 361/695 |
| 2008/0014093 | A1 * | 1/2008 | Fan et al. | 416/244 R |

* cited by examiner

*Primary Examiner* — Edward Look
*Assistant Examiner* — Christopher J Hargitt
(74) *Attorney, Agent, or Firm* — Novak Druce Connolly Bove + Quigg LLP

(57) ABSTRACT

A fan module includes a bracket, a mounting plate, and a fan fixed to the mounting plate. A first side of the mounting plate is pivotably attached to the bracket. A second side of the mounting plate can be fixed to different positions on the bracket.

3 Claims, 5 Drawing Sheets

FAN MODULE

BACKGROUND

1. Technical Field

The present disclosure relates to a fan module.

2. Description of Related Art

Electronic devices often include internal fans for heat dissipation. The fans are often fixed to the casing of the devices with screws, and so are not adjustable to customize airflow direction.

BRIEF DESCRIPTION OF THE DRAWINGS

Many aspects of the present embodiments can be better understood with reference to the following drawings. The components in the drawing are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
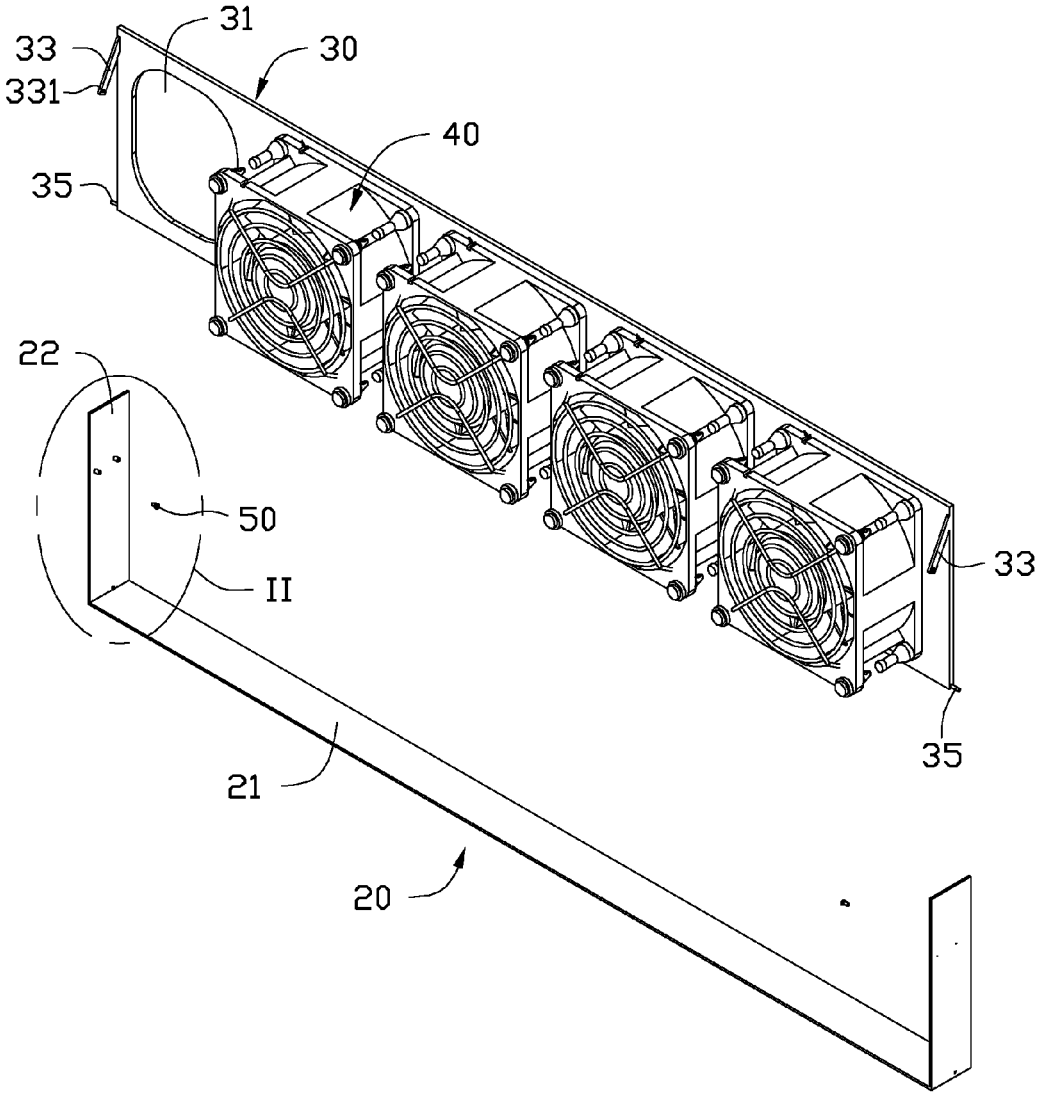
FIG. 1 is an exploded, isometric view of a fan module in accordance with an exemplary embodiment.
Figure 2:
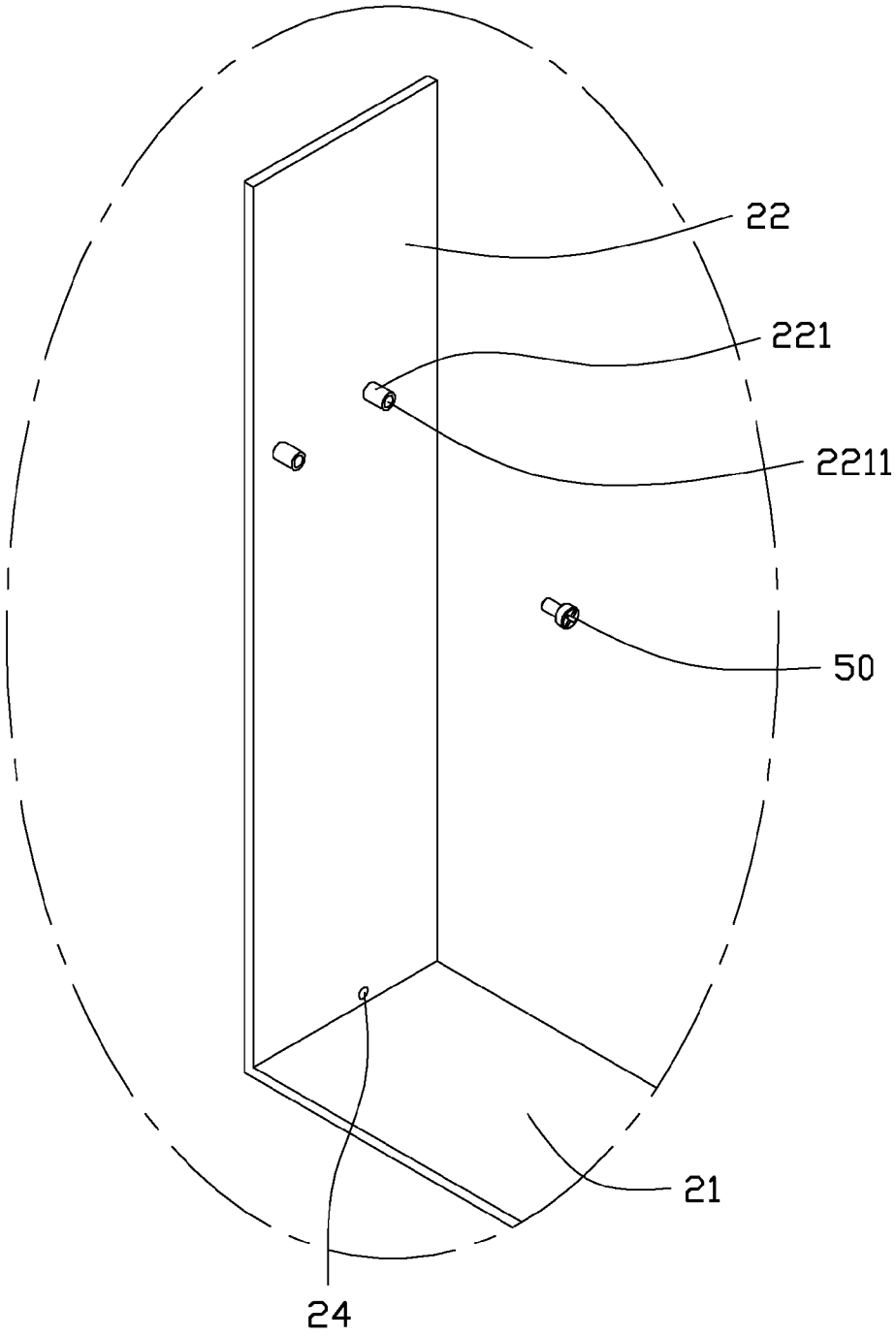
FIG. 2 is an enlarged view of an encircled portion II of FIG. 1.

Referring to FIG. 1 and FIG. 2, an embodiment of a fan module includes a bracket 20, a mounting plate 30, a plurality of fans 40 fixed to the mounting plate 30, and two fasteners 50. In this embodiment, the fasteners 50 are screws.

The bracket 20 includes a bottom plate 21, and two side plates 22 perpendicularly extending up from opposite ends of the bottom plate 21. Two columnar pins 221 protrude from an upper portion of each side plate 22 toward the other side plate 22. Each tab 221 axially defines a mounting hole 2211. Each side plate 22 defines a hole 24 adjacent to the bottom plate 21.

The mounting plate 30 defines a plurality of vents 31 each corresponding to a fan 40. Two arms 33 extend slantingly downward from upper portions of two opposite ends of the mounting plate 30. A through hole 331 is defined in a distal end of each arm 33 opposite to the upper portion. Two rods 35 extend outward from lower portions of the opposite ends of the mounting plate 30. Depending on need, the number of rods 35 can be varied.

Figure 3:
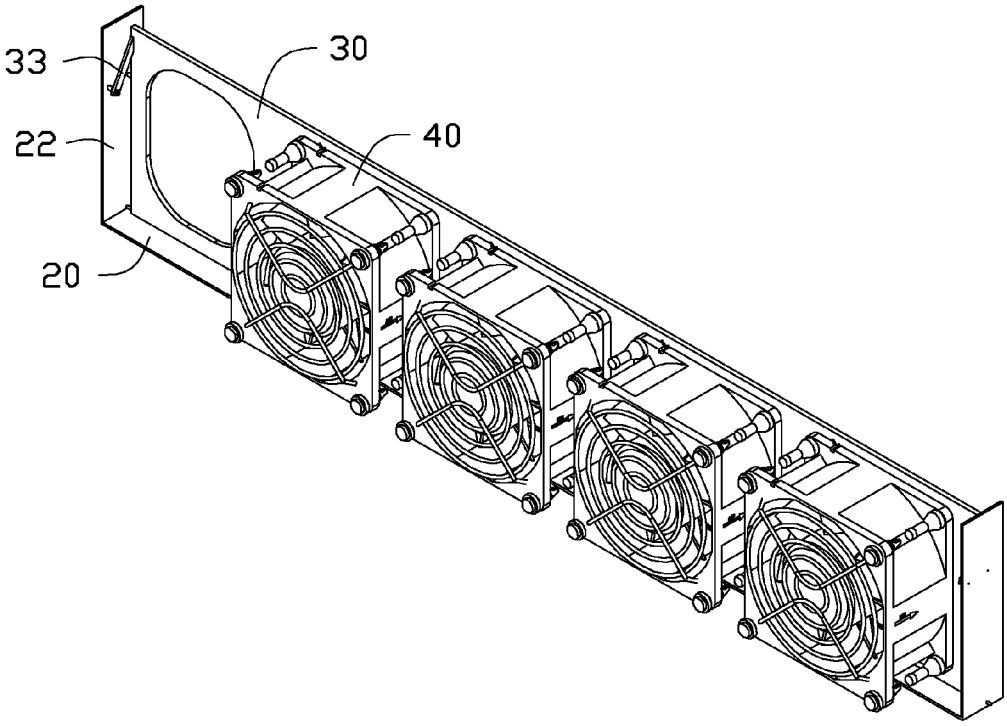
FIG. 3 is an assembled, isometric view of the fan module of FIG. 1.
Figure 4:
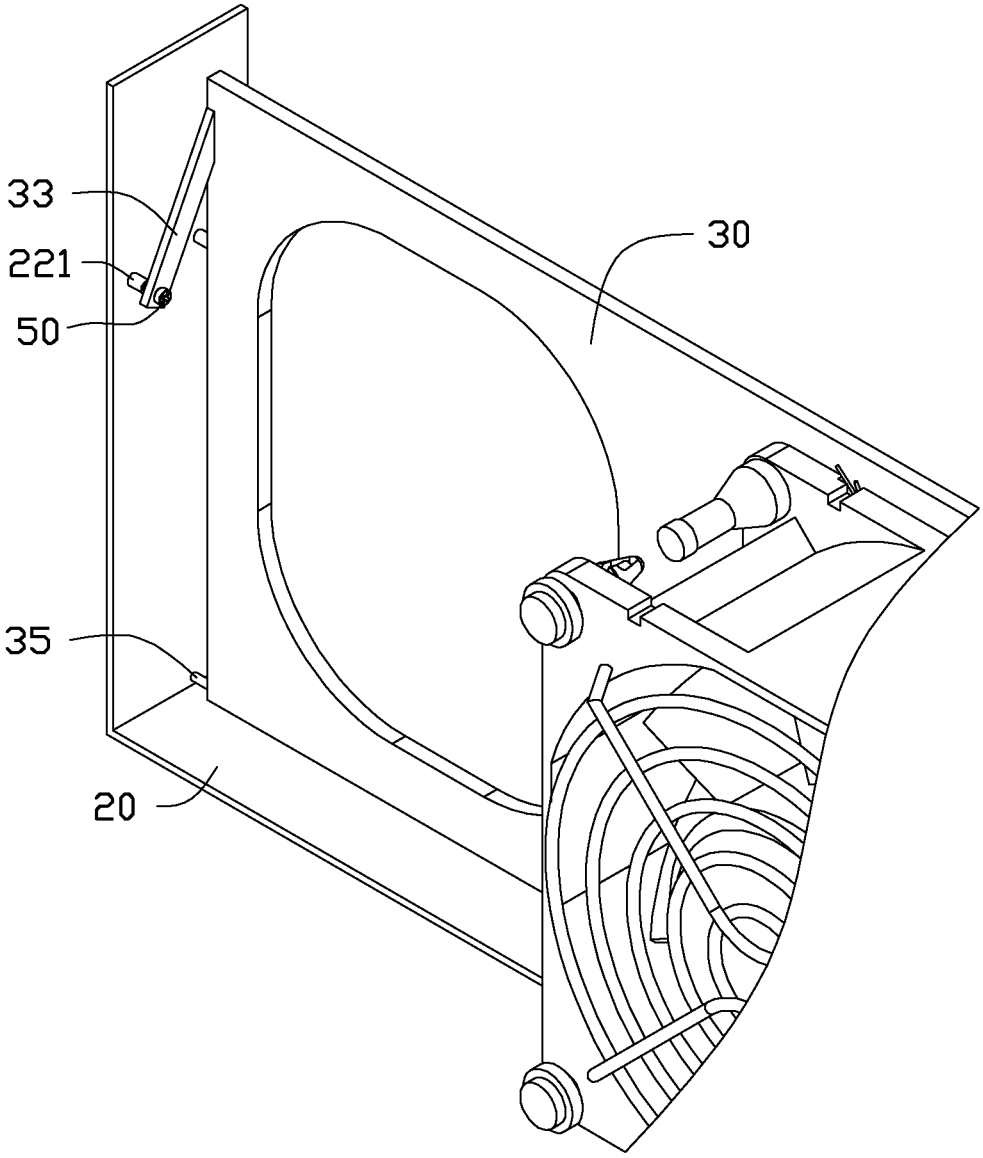
FIG. 4 is an enlarged view of part of FIG. 3.

Referring to FIG. 3 and FIG. 4, in assembly, the rods 35 are pivotably inserted in the corresponding holes 24. The through hole 331 of each arm 33 aligns with one of the pins 221 of the corresponding side plate 22. The fastener 50 extends through the through hole 331 to be screwed in the mounting hole 2211 to position the mounting plate 30 relative to the bracket 20.

Figure 5:
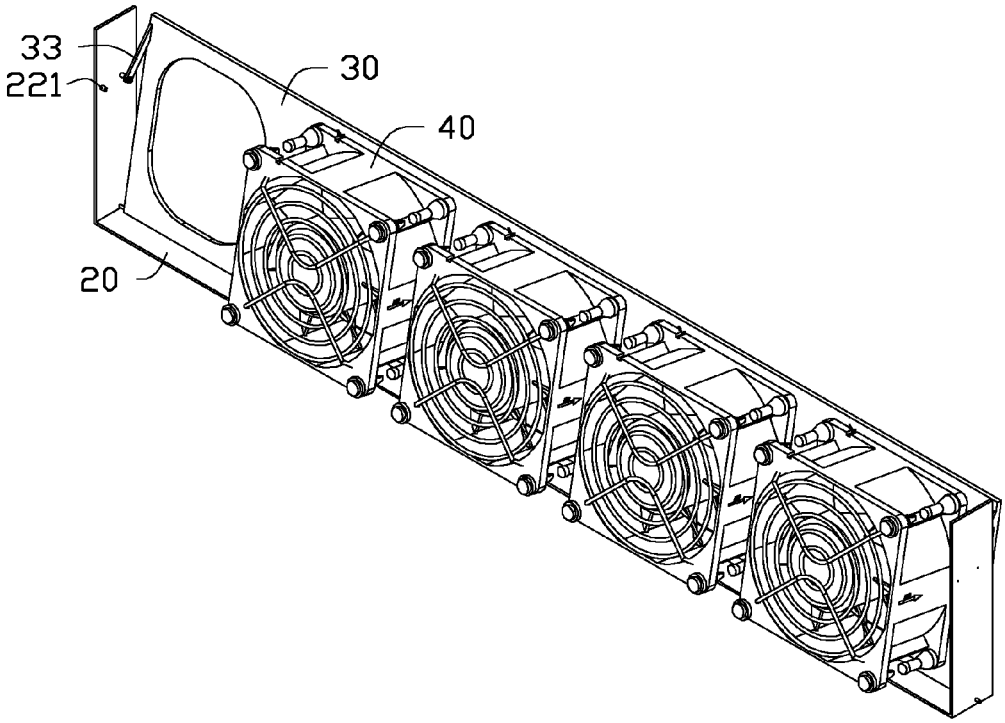
FIG. 5 is similar to FIG. 3, but shows another state of use.

Referring to FIG. 5, to adjust the airflow direction of the fans 40, each arm 33 is adjustable to be fixed to the other pin 221, thereby adjusting an angle between the mounting plate 30 and the bottom plate 21.

Even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A fan module, comprising:

a bracket;

a mounting plate, wherein a first side of the mounting plate is pivotably mounted to the bracket, a second side of the mounting plate opposite to the first side is adjustable to be fixed to different positions of the bracket; and at least one fan fixed to the mounting plate;

wherein the bracket comprises a bottom plate and two side plates extending up from opposite ends of the bottom plate, each of the side plates defines a hole adjacent to the bottom plate, two pins extend out from the first side of the mounting plate, to be pivotably inserted in the holes respectively; and wherein two or more rods extend from each of the side plates, two arms respectively extend from opposite ends of the second side of the mounting plate, each arm is adjustable to be fixed to one of the rods of a corresponding side plate.

2. The fan module as claimed in claim 1, wherein the arms extend slantingly downward from the opposite ends of the second side of the mounting plate.

3. The fan module as claimed in claim 1, wherein each of the pins axially defines a mounting hole, each of the arms defines a though hole, a fastener extends through the through hole to be screwed in the corresponding mounting hole.

* * * * *